US007076917B2

(12) United States Patent
Chang

(10) Patent No.: US 7,076,917 B2
(45) Date of Patent: Jul. 18, 2006

(54) DRIVING SYSTEM FOR GARAGE DOOR

(75) Inventor: Chung-Min Chang, Taichung (TW)

(73) Assignee: Rhine Electronic Co., Ltd., Taichung (TW)

( * ) Notice: Subject to any disclaimer, the term of this patent is extended or adjusted under 35 U.S.C. 154(b) by 337 days.

(21) Appl. No.: 10/729,953

(22) Filed: Dec. 9, 2003

(65) Prior Publication Data

US 2005/0120629 A1 Jun. 9, 2005

(51) Int. Cl.
*E05F 15/00* (2006.01)

(52) U.S. Cl. ..... 49/139; 49/197; 160/189

(58) Field of Classification Search ..... 49/197, 49/199, 139, 140; 160/188, 189, 201; 74/625
See application file for complete search history.

(56) References Cited

U.S. PATENT DOCUMENTS 3,858,452 A * 1/1975 Gatland et al. ..... 74/424.78
4,311,225 A * 1/1982 Tsubaki et al. ..... 192/142 R
4,794,731 A * 1/1989 Willmott et al. ..... 49/199
5,222,403 A * 6/1993 Angelini et al. ..... 74/89.21
6,173,532 B1 * 1/2001 Beausoleil ..... 49/199
6,557,301 B1 * 5/2003 Hormann et al. ..... 49/139

FOREIGN PATENT DOCUMENTS

GB 2086983 A * 5/1982
WO WO93/09324 * 5/1993

* cited by examiner

*Primary Examiner*—Jerry Redman
(74) *Attorney, Agent, or Firm*—Rosenberg, Klein & Lee

(57) ABSTRACT

A driving system for a garage door includes a track having an end fixed on an inside of a wall and has an open side that faces upward. A driving assembly is movably received in the track and driven by a motor. The driving assembly includes a connection member to which two ends of a power transferring member are connected. A U-shaped member is movably engaged with the track from an underside of the track and two sides of the U-shaped member are connected to the driving assembly. A link is pivotably connected between the U-shaped member and the garage door. The power transferring member reeves a gear which is rotatably connected to the track and the motor has a driving shaft which is conveniently extended through an opening of the track and engaged with an engaging hole of the gear.

9 Claims, 9 Drawing Sheets

DRIVING SYSTEM FOR GARAGE DOOR

FIELD OF THE INVENTION

The present invention relates to a driving system for a garage door and the driving system is easily to assemble and includes a convenient quick release device.

BACKGROUND OF THE INVENTION

A conventional garage door is generally composed of several plates which are pivotably connected with each other and can be moved along two side rails by a driving system. The driving system includes a motor that drivers a threaded rod and a connection member is threadedly connected to the threaded rod so that when the threaded rod is rotated, the connection member is moved on the threaded rod. Two ends of a chain are connected to the connection member such that when the threaded rod is rotated, the chain is moved to open and close the garage door. This system involves a complicated structure that requires a lot of time to install. The chain is composed of several plates which are connected by pins and the plates could be jammed at a certain angle during operating if the connection portions of the pins and the plates lack proper lubrication. Furthermore, the threaded rod is received in a track which includes an open side facing downward and lubricant on the threaded rod could drop on the vehicle or people who stand under the track.

The present invention intends to provide a driving system for a garage door that is easily to be installed and the open side of the track faces upward.

Another object of the present invention is to provide a quick release device for manual operation of the garage door.

SUMMARY OF THE INVENTION

The present invention relates to a driving system for a garage door and comprises a track cantilevered to a wall and having an open side that faces upward. A driving assembly is movably received in the track and driven by a motor which is located to the other end of the track. A power transferring member has two ends connected to the driving assembly. A U-shaped member is movably engaged with the track from an underside of the track and two sides of the U-shaped member are connected to the driving assembly. One end of a link is pivotably connected to the U-shaped member and the other end of the link is connected to the garage door.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 7:
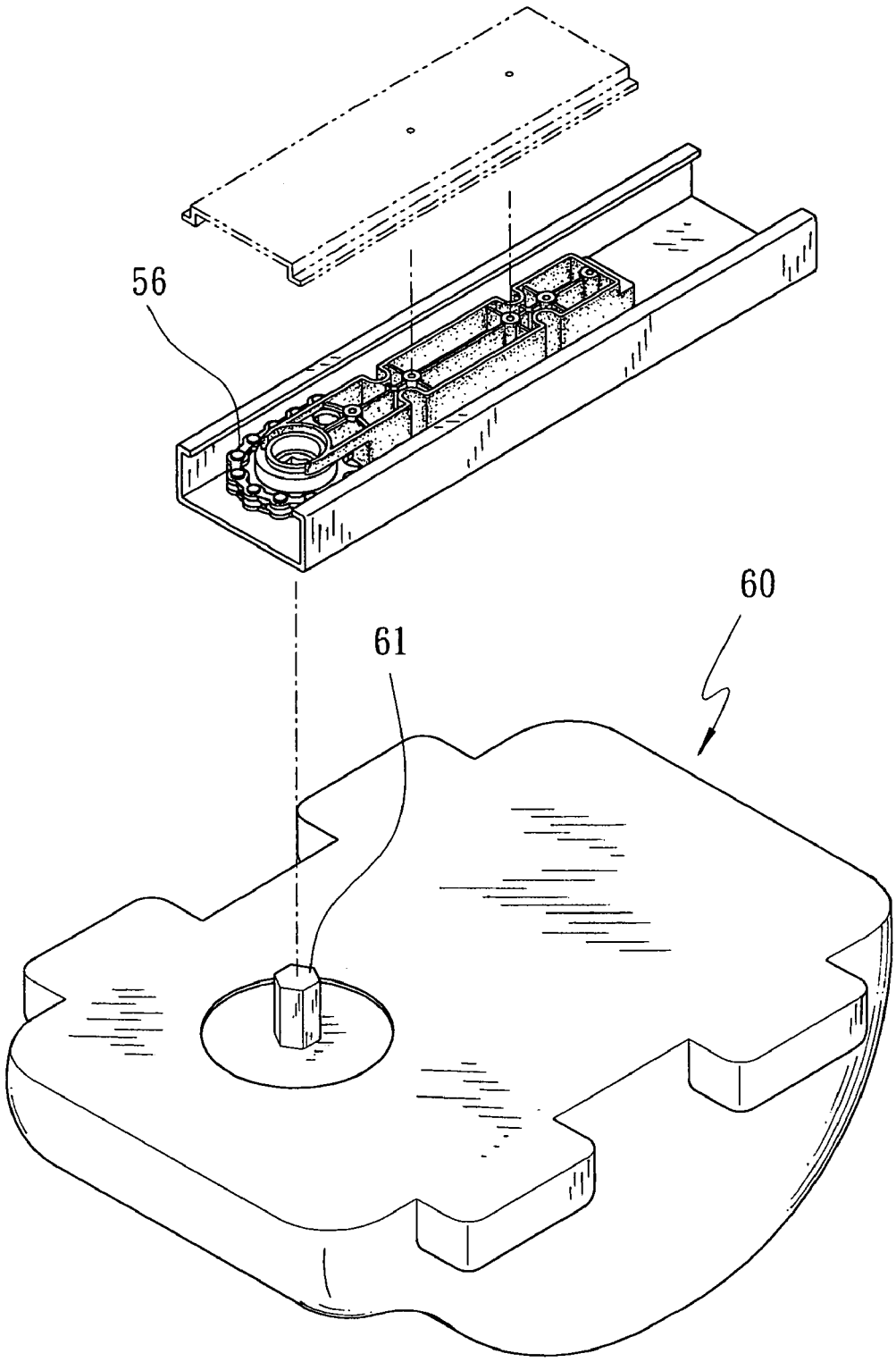
FIG. 7 shows a driving shaft of a motor and the gear of the driving system of the present invention.

Referring to FIGS. 1 to 5, the driving system 10 for a garage door 11 of the present invention comprises a track 12 which has one end thereof fixed on an inside of a wall 11 and the other end of the track 12 is connected to a motor 60 (FIG. 7). The track 12 has an open side that faces upward and a driving assembly 20 is movably received in the track 12 and driven by the motor 60.

Figure 9:
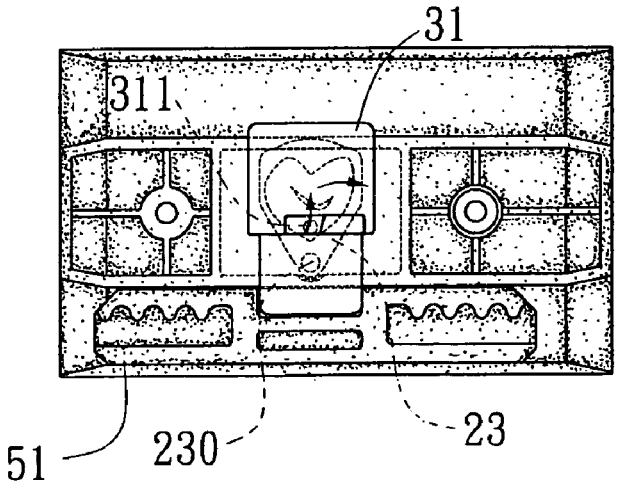
FIG. 9 shows that the pulling member is engaged from the connection member.

The driving assembly 20 comprises a base 21 and a cover 22 which is mounted to the base 21. The base 21 has two grooves 210 and the cover 22 has two grooves 220 which are located in alignment with the grooves 210. A connection member 51 has a clamping recess 510 defined in each of two ends thereof and the connection member 51 is movably received in a space defined by the aligned groove 210 and the groove 220. A power transferring member 50 such as a toothed belt which includes two ends that are respectively engaged with the two clamping recesses 510. Therefore, when the connection member 51 is moved in the grooves 210, 220, the belt is moved in the grooves 210, 220 with the connection member 51. The cover 22 has a window 222 and the base 21 has a concavity 211 defined in a top thereof. A quick release mechanism 30 includes a retaining member 23 and a pulling member 31, wherein the retaining member 32 is located between the base 21 and the cover 22. A protrusion 230 extends from an underside of an end of the retaining member 23 and is rotatably received in the concavity 211 so that the retaining member 31 may pivot or swing about the protrusion 230. A recessed area 231 is defined in a top of the retaining member 23 and a stop 232 extends from a surface of the recessed area 231 so as to define an annular path around the stop 232. The pulling member 31 is overlapped on the retaining member 23 and has a tongue 310 extending from an end thereof. The tongue 310 extends through a gap 221 defined in a protrusion portion located at the underside of the cover 22 so as to be removably engaged with a recess 511 defined in a side of the connection member 51 as shown in FIG. 9. A top plate 312 extends from a top of the pulling member 31 and movably extends through the window 222 of the cover 22. A boss 311 extends from an underside of the pulling member 31 and is movably engaged in the annular path of the retaining member 23.

A spring 32 has one end 321 connected to a hole 315 in the top plate 312 and the other end of the spring 32 is hooked to a ring 224 on the cover 22 so as to bias the tongue 310 to be normally engaged with the recess 511 of the connection member 51. A rope 33 has an end fixed to a hole 313 of the top plate 314 such that when the user pulls the rope 33, the top plate 312 is removed and the tongue 310 is disengaged from the recess 511 of the connection member 51. A notch 314 is defined in the top plate 321 and located beside the hole 313 for being connected to another rope which is not shown.

A U-shaped member 40 is movably engaged with the track 12 from an underside of the track 12 and two sides of the U-shaped member 40 are connected to the driving assembly 20. The cover 22 having two lugs 223 extending from a top of each of two sides thereof and two pins 24 extend through the two sides of the U-shaped member 40, two mediate members 70 and the two respective pairs of lugs 223 aligned with each other. One of the mediate members 70 has a guide hole 700 in an end thereof so that the rope 33 is engaged with the guide hole 700.

Figure 10:
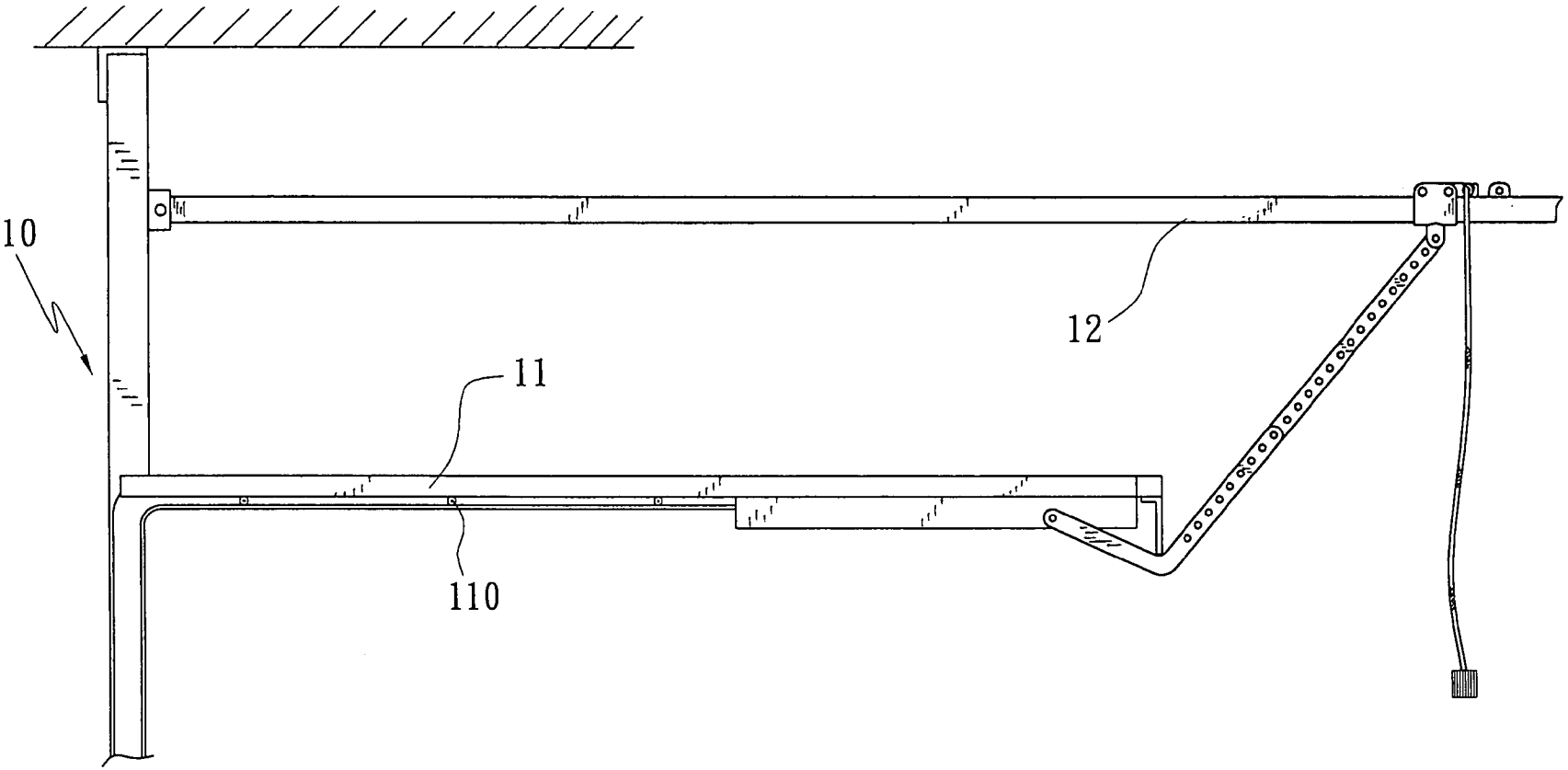
FIG. 10 shows the garage door is opened by operation of the driving system of the present invention.

A link system includes a straight first link 41 and an L-shaped second link 42, one end of the first link 41 is pivotably connected to a hole 402 in an extension plate 401 on the U-shaped member and the other end of the first link 41 is connected to a first end of the second link 42 by extending pins through positioning holes 410 and 420 in the first link 41 and the second link 42. A second end of the second link 42 is connected to the garage door 11. As shown in FIG. 10, when the motor 60 is activated and drives the belt, the connection member 51 is moved and the link system pulls the garage door 11. The garage door 11 is composed of several plates which are connected with each other pins 110 and the garage door 11 can be bent and pulled to be opened.

Figure 1:
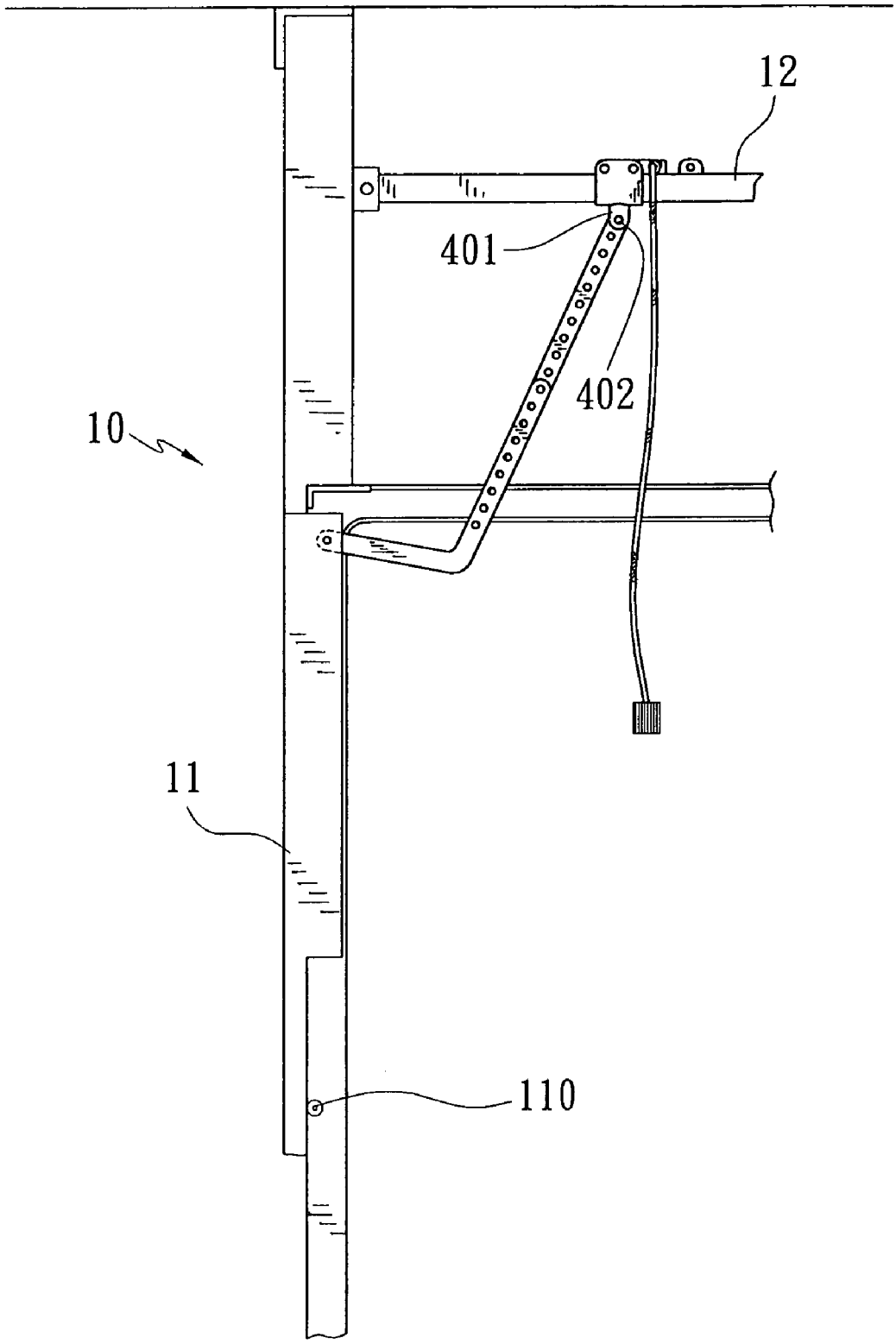
FIG. 1 shows the driving system connected to a garage door which is in close position.
Figure 2:
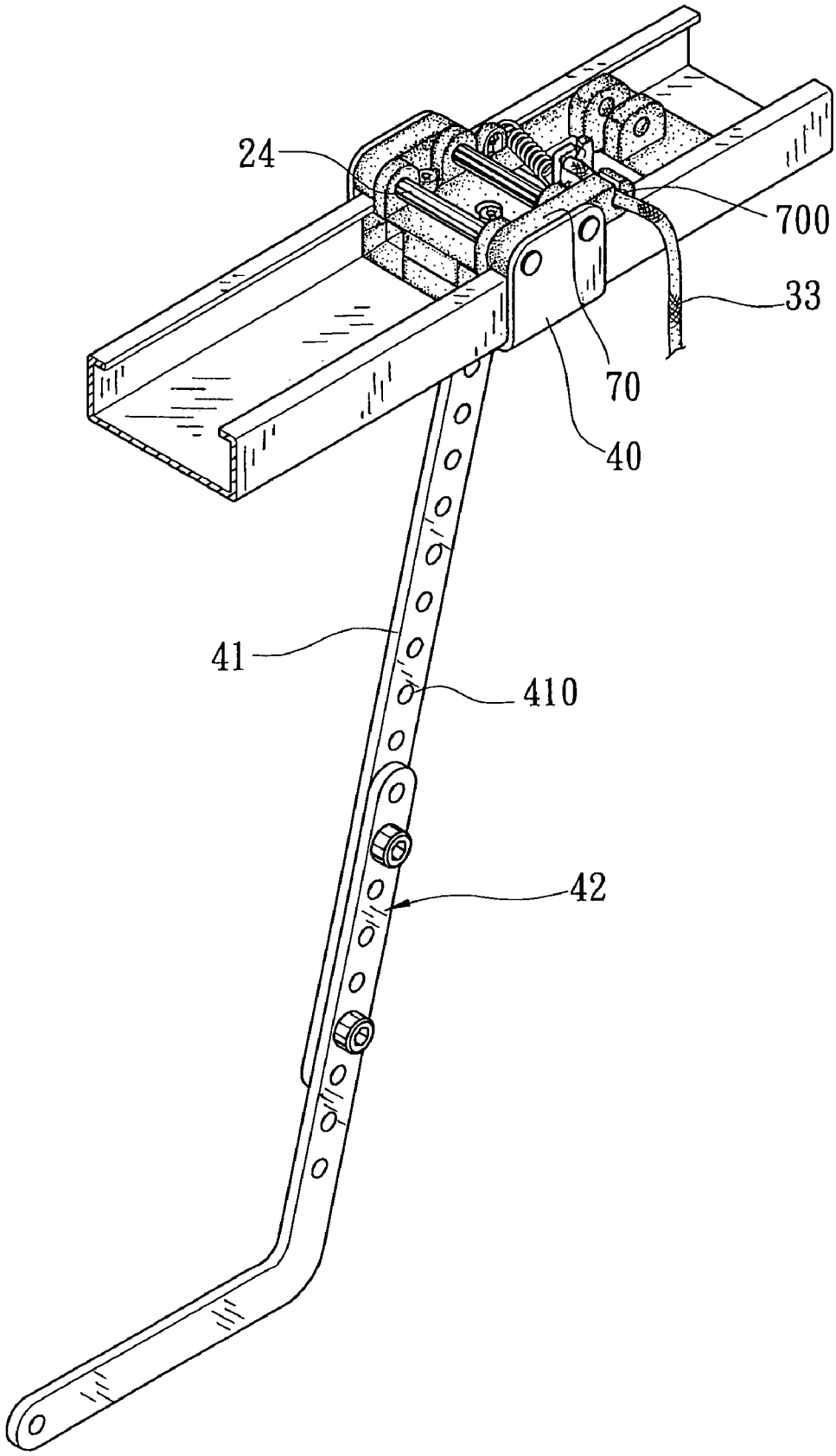
FIG. 2 is a perspective view to show the driving system and the links.
Figure 3:
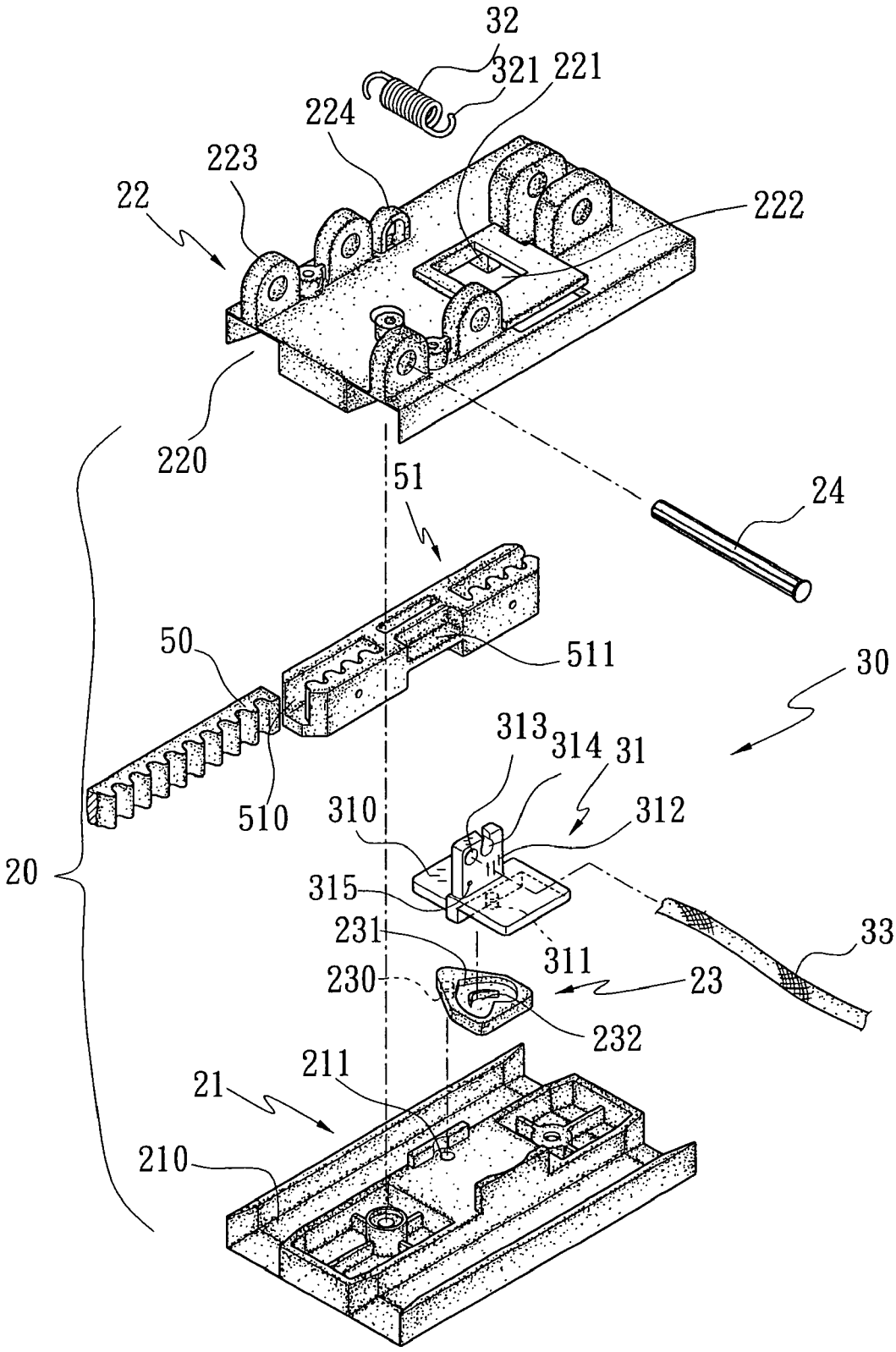
FIG. 3 is an exploded view to show the driving system of the present invention.
Figure 4:
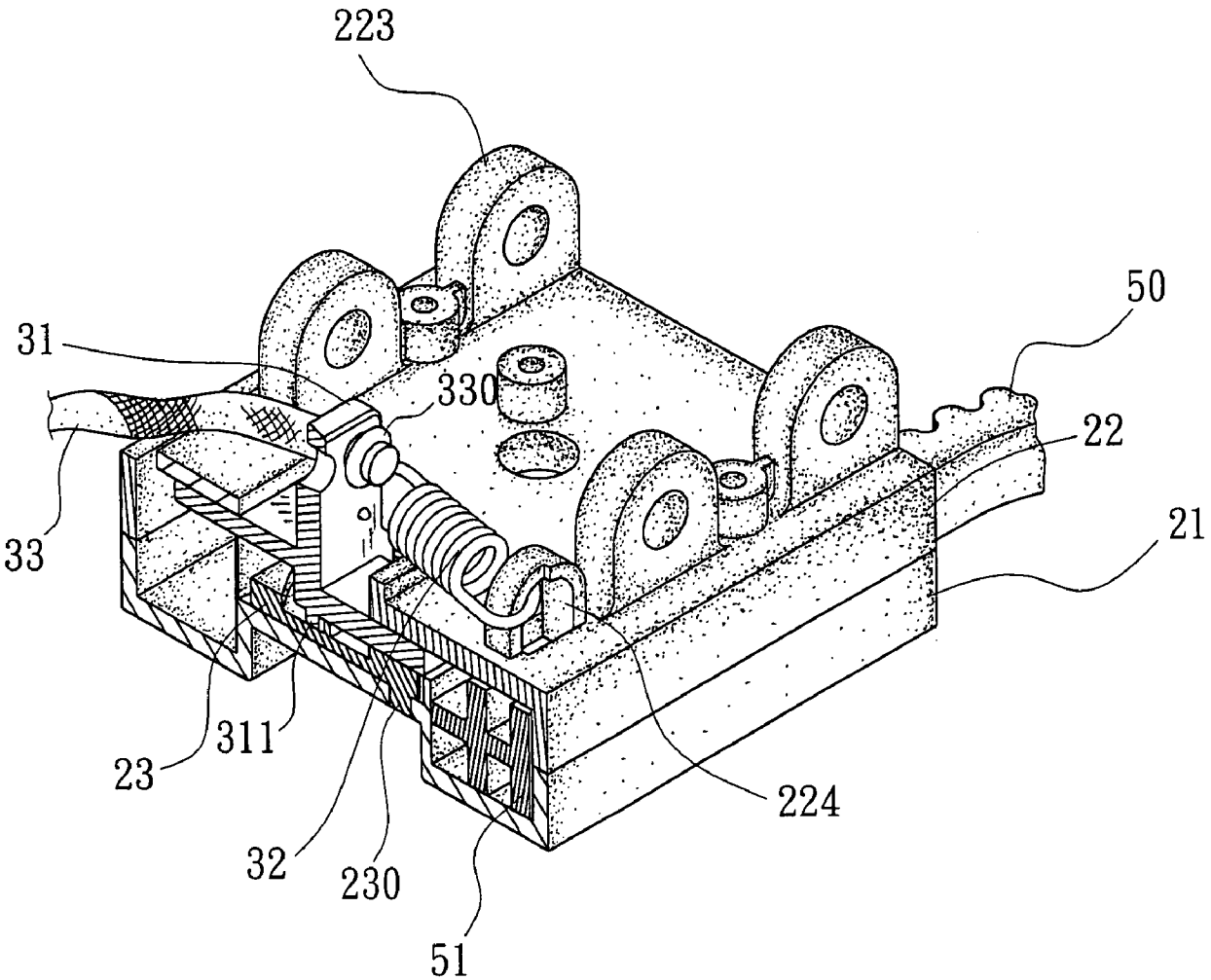
FIG. 4 shows the engagement of the pulling member and the connection member of the driving system of the present invention.
Figure 5:
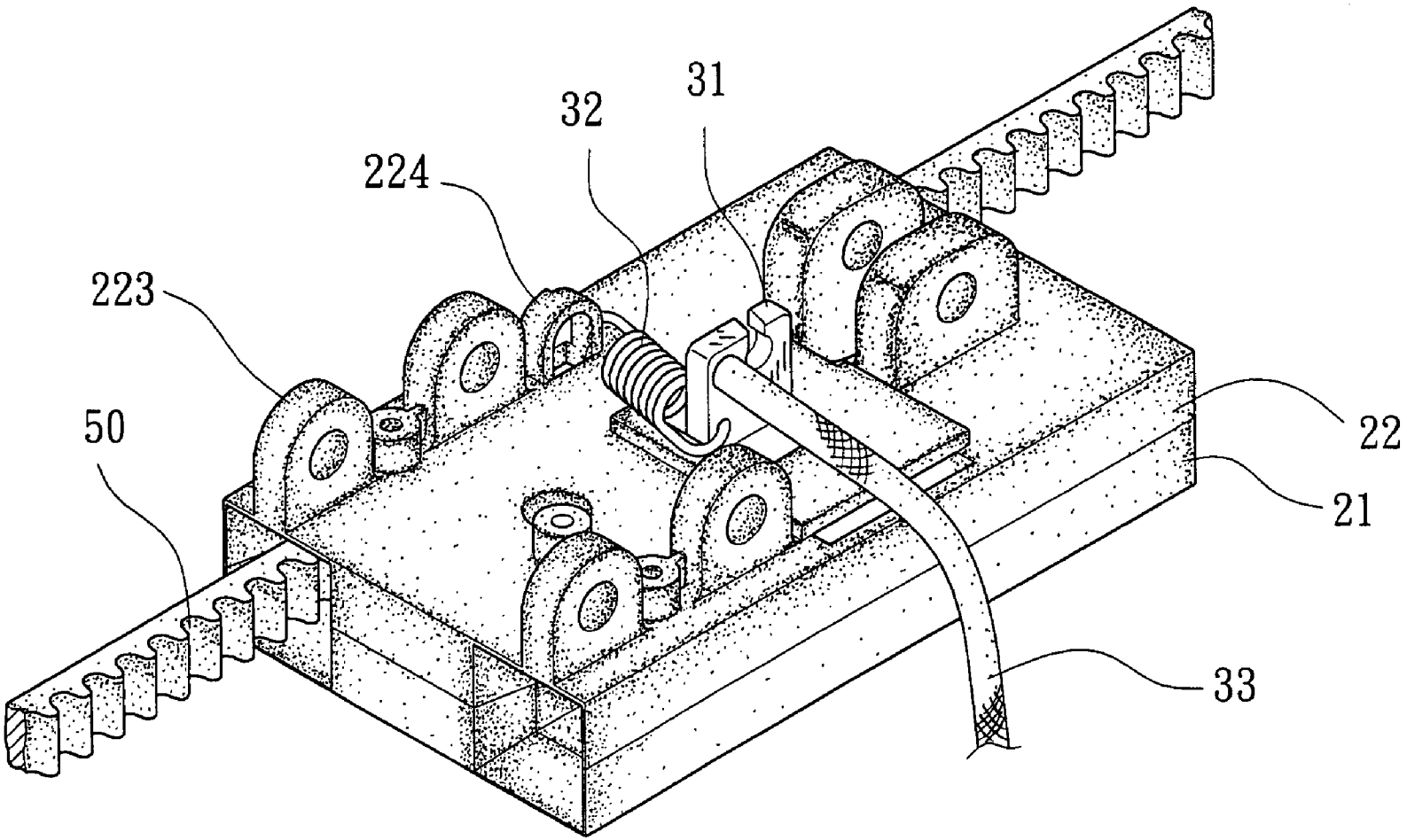
FIG. 5 is a perspective view to show the driving system of the present invention.
Figure 6:
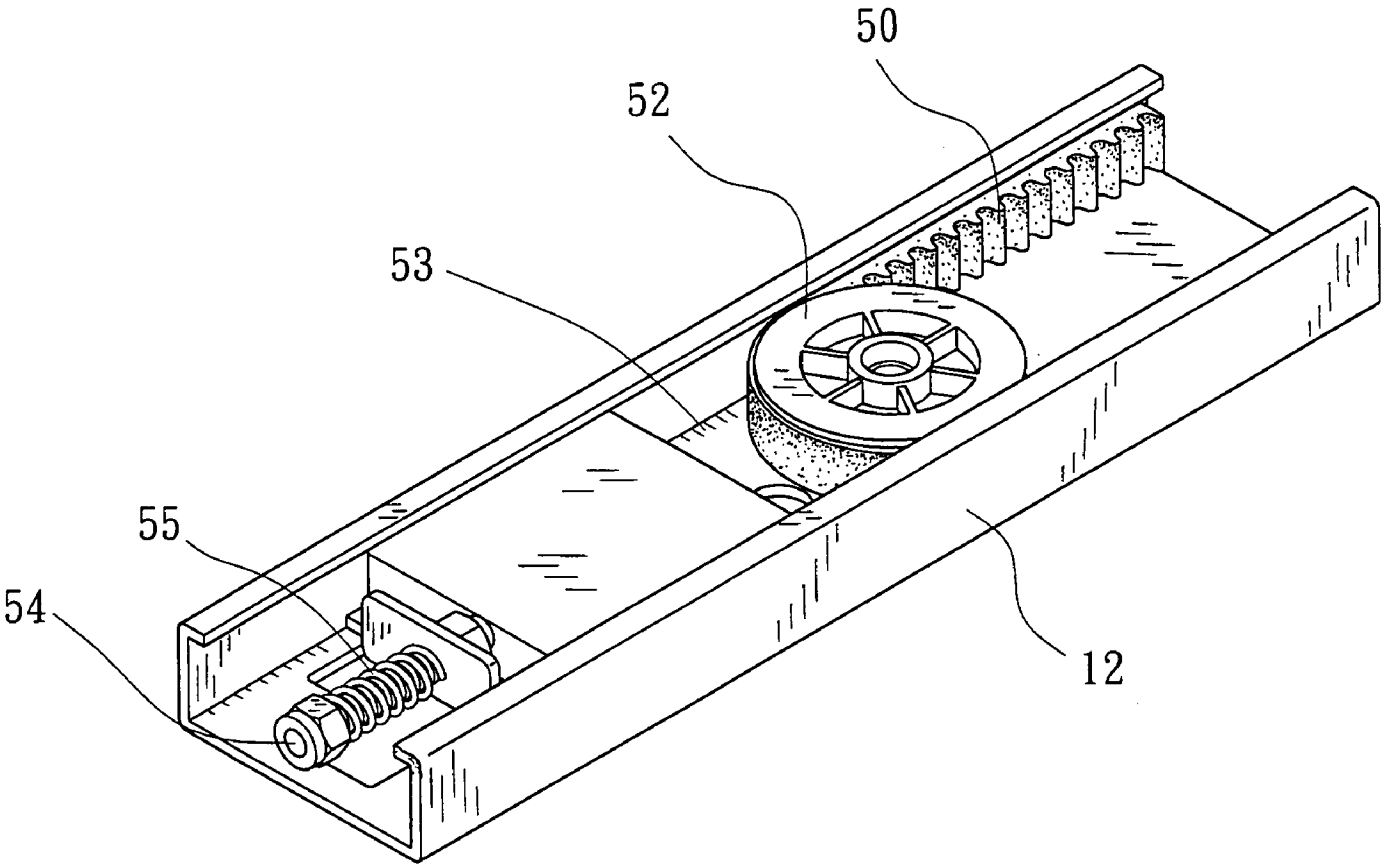
FIG. 6 shows the power transferring member is a belt which reeves through a wheel.

As shown in FIG. 6, the power transferring member 50 reeves a gear 52 in the second end of the track 12 and the gear 52 is connected to a board 53. A adjusting bolt 54 extends through a block fixed in the track 12 and is connected to the board 53. A spring 55 is mounted to the bolt 54 and biased between the block an the head of the bolt 54 so that the distance from the gear 52 to the first end of the track 12 can be adjusted by rotating the adjusting bolt 54.

Figure 8:
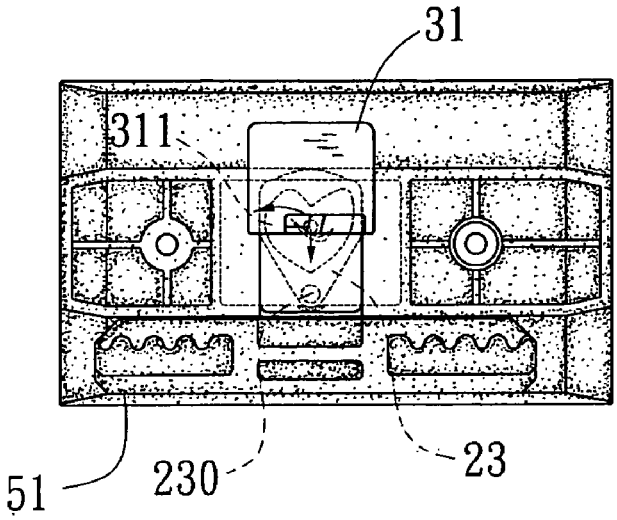
FIG. 8 shows that the pulling member is pulled and disengaged from the connection member.

Referring to FIG. 8, when the driving system 10 cannot receive the signal from a remote control of the garage door 11, the user may pull the rope 33 to disengage the tongue 310 from the recess 511 in the connection member 51. When first pulling the rope 33, the boss 311 of the pulling member 31 is moved backward along the annular path around the stop member 232 in the retaining member 23 and then is stopped by the stop member 232 when releasing the rope 33 so that the tongue 310 is kept at a position that is disengaged from the recess 511 of the connection member 51. If the user pulls the rope 33 again, the boss 311 leaves the stop member 232 and goes back to its original position as shown in FIG. 9.

As shown in FIG. 7 which shows another embodiment of the gear 520 and the power transferring member, wherein the gear 520 is rotatably located in the track 12 and has an engaging hole defined therethrough. The power transferring member is a chain 56 which reeves through the gear 520. The track 12 has an opening defined therethrough and located in alignment with the engaging hole of the gear 52. The motor 60 has a driving shaft 61 extending therefrom and the shaft 61 extends through the opening of the track 12 and engaged with the engaging hole of the gear 520. This is typically convenient for the assemblers to connect the motor 60 and the driving system of the garage door.

While we have shown and described the embodiment in accordance with the present invention, it should be clear to those skilled in the art that further embodiments may be made without departing from the scope of the present invention.

What is claimed is:

1. A driving system for a garage door, comprising:

a track having an end adapted to be fixed on an inside of a wall and having an open side that faces upward, a driving assembly movably received in the track and adapted to be driven by a motor, the driving assembly including:

a base and a cover mounted to the base, the base having two grooves and the cover has two grooves which are located in alignment with the two grooves on said base, and a connection member having a clamping recess formed in each of two ends thereof, said two ends respectively engaged with the two clamping recesses, said connection member being movably received in a space defined by the aligned grooves of the base and cover;

a power transferring member having two ends, the two ends of the power transferring member being respectively engaged with the two clamping recesses of the connection member of the driving assembly, and a U-shaped member movably engaged with the track from an underside of the track and two sides of the U-shaped member being connected to the driving assembly, one end of a link being pivotally connected to the U-shaped member and the other end of the link being adapted to be connected to a garage door.

2. The system as claimed in claim 1, wherein the cover has a window and the base has a concavity formed in a top thereof for receiving a retaining member having a protrusion extending from an underside of an end thereof, the protrusion being rotatably received in the concavity, a recessed area being formed in a top of the retaining member and a stop extending from a surface of the recessed area to thereby form an annular path around the stop, a pulling member having a tongue extending from an end thereof and being removably engaged with a recess formed in a side of the connection member and a top plate extending from a top of the pulling member, the top plate movably extending through the window of the cover, a boss extending from an underside of the pulling member and movably engaged in the annular path of the retaining member, a spring connected between the top plate and a ring on the cover to bias the tongue to be engaged with the recess of the connection member, a rope connected to the top plate to pull the top plate to disengage the tongue from the recess of the connection member.

3. The system as claimed in claim 1, wherein the cover having two lugs extending from a top of each of two sides thereof and further having two pins extending through the two sides of the U-shaped member and through the two respective pairs of lugs which are aligned one with respect to the other.

4. The system as claimed in claim 1, wherein a gear is rotatably located in the track and has an engaging hole formed therethrough, the track having an opening formed therethrough and located in alignment with the engaging hole of the gear, the power transferring member being engaged with the gear, the motor having a driving shaft extending therefrom and the shaft extending through the opening of the track and engaged with the engaging hole of the gear.

5. The driving system for a garage door, comprising:

a track having an end adapted to be fixed on an inside of a wall, a driving assembly movably received in the track and adapted to be driven by a motor, the driving assembly including:

a base and a cover which is mounted to the base, the base having a groove which is located in alignment with a groove on said cover, and a connection member having a clamping recess formed in each of two ends thereof, the connection member being movably received in a space defined by the aligned grooves, a power transferring member having two ends, the two ends of the power transferring member being respectively engaged with the clamping recesses of the connection member of the driving assembly, a gear rotatably located in the track and having an engaging hole formed therethrough, the track having an opening formed therethrough and located in alignment with the engaging bole of the gear, the power transferring member being engaged with the gear; the motor having a driving shaft extending therefrom and the shaft extending through the opening of the track and being engaged with the engaging hole of the gear, and a link, one end of the link being pivotally connected to the driving assembly and the other end of the link being adapted to be connected to a garage door.

6. The system as claimed in claim 5, wherein the track has an open side that faces upward and a U-shaped member being movably engaged with the track from an underside of the track, two sides of the U-shaped member being connected to the driving assembly.

7. The system as claimed in claim 6, wherein the cover has two lugs extending from each of a top of each of two sides thereof and further having two pins extending through the two sides of the U-shaped member and also through the two respective pairs of lugs which are aligned one with respect to the other.

8. The system as claimed in claim 5, wherein the cover has a window and the base has a concavity formed in a top thereof, a retaining member having a protrusion extending from an underside of an end thereof and the protrusion being rotatably received in the concavity, a recessed area being formed in a top of the retaining member and a stop extending from a surface of the recessed area to thereby form an annular path around the stop, a pulling member having a tongue extending from an end thereof and being removably engaged with a recess formed in a side of the connection member and a top plate extending from a top of the pulling member, the top plate movably extending through the window of the cover, a boss extending from an underside of the pulling member and movably engaged in the annular path of the retaining member, a spring connected between the top plate and a ring on the cover to bias the tongue to be engaged with the recess of the connection member, a rope connected to the top plate to pull the top plate to disengage the tongue from the recess of the connection member.

9. A driving system for a garage door, comprising:

a track having an end adapted to be fixed on an inside of a wall and an open side that faces upwardly, a U-Shaped member being movably engaged with said track from the underside of the track, a driving assembly movably received in the track and adapted to be driven by a motor, a cover having two lugs extending from a top of each of two sides thereof, the cover further having two pins extending though the two sides of the U-Shaped member and also through the two respective pairs of lugs which are aligned one with respect to the other, a power transferring member having two ends and the two ends of the power transferring member being connected to the driving assembly, one end of a link being pivotably connected to the U-shaped member and the other end of the link adapted to be connected to a garage door.

* * * * *